United States Patent [19]

Helander

[11] Patent Number: 4,460,110

[45] Date of Patent: Jul. 17, 1984

[54] OPENABLE CLOSING DEVICE FOR FREIGHT OR STORAGE TANKS

[75] Inventor: Pertti J. Helander, Kuopio, Finland

[73] Assignee: Esko Pollto Oy, Helsinki, Finland

[21] Appl. No.: 356,282

[22] Filed: Mar. 9, 1982

[51] Int. Cl.[3] ..... B67D 3/00

[52] U.S. Cl. ..... 222/504; 222/491; 222/528; 105/240

[58] Field of Search ..... 222/491, 504, 505, 506, 222/526, 527, 528, 531; 105/240, 296, 297, 298, 282 R; 298/27, 24, 6, 7; 220/200, 260, 262, 339, 350

[56] References Cited

U.S. PATENT DOCUMENTS

| | | | |
|---|---|---|---|
| 2,284,781 | 6/1942 | Ward | 222/505 |
| 3,631,812 | 1/1972 | Winslow, Jr. | 222/505 |

FOREIGN PATENT DOCUMENTS

| | | | |
|---|---|---|---|
| 1943940 | 4/1971 | Fed. Rep. of Germany . | |
| 102370 | 6/1963 | Norway | 222/504 |

*Primary Examiner*—Joseph J. Rolla
*Assistant Examiner*—C. Compton
*Attorney, Agent, or Firm*—Norbert P. Holler; Charles A. Blank

[57] ABSTRACT

So that a freight or storage tank for bulk material, that has at least one long emptying hole on the bottom, can be closed and opened, the tank has at least one flexible belt that extends essentially over the length of the opening and whose one end is attached to the tank, and under which is a roller or roller system that is approximately of the same length and that supports the belt when in the closed position and that can be removed from the closed position, as well as elements to move the roller or roller system across the opening between two extreme positions. Elements that guide the roller or roller system between the two extreme positions by way of the top dead center and operating elements that force the roller or roller system over the top dead center are fitted onto the tank's frame so that the opening is closed more firmly the greater the tank's load and so that the load's weight is used in opening the opening and so that a loosening effect upon the tank's contents is achieved when the opening is opened.

The belt may also be endless essentially covering the whole width of the opening and mounted over the roller system's rollers.

10 Claims, 6 Drawing Figures

OPENABLE CLOSING DEVICE FOR FREIGHT OR STORAGE TANKS

BACKGROUND OF THE INVENTION

This invention relates to an apparatus for openably closing a freight or storage tank for bulk material, such as granules, powders, or semisolid substances. This invention relates particularly to an apparatus for opening and closing such a tank that has at least one long outlet hole at the bottom, one or two flexible belts that are essentially as long as the opening and are fastened at one end to the tank, a roller or roller system that is under the belt and is approximately of the same length supporting the belt in the closed position and that can be removed from the closed position, and elements for moving the roller or roller system across the opening between two extreme positions.

The emptying of the tank is based either partially or completely on the utilization of gravity. The closing devices in use are usually rigid flaps that are hinged onto the tank's frame in a suitable manner. The sealing of the doors, their staying in shape, and maintenance have become problems in heavy applications such as in earthload transport equipment and in railway equipment. During the winter it is often difficult to start the material moving when it is frozen on the other side of the door. Because the door's opening movement does not create any breaking up of the unloading material, the frozen crust prevents the material from starting to move. Further the flap-doors' constructional difficulties often compel making them unnecessarily small in comparison to the tank's volume. In especially heavy applications such as in transporting rocky material or ore, the door must withstand strong impacts during loading to which a flap-door construction is not well suited. When the transporting of masses is in question, for example in using so-called whole freight-train transportations, it is desired that the opening and closing of the doors could be done automatically by giving an impulse from a device that is near the rails. The door arrangements in use are not well suited for this.

In vehicle applications such as in highway and in railway transportations the main restriction in the dimensions of the tank is its width being 2.5–3 m. The length may be as much as 15–20 m for light goods. When using typical flap- and sectional doors long tanks require several doors because as the length of the door increases, it is difficult to achieve the necessary rigidness that the sealing requires.

Such an opening and closing device for silos is known which consists of a belt that covers the silo's opening when it is in the unwound position and whose one end is fastened to one side of the silo's opening while the other end is fastened to a roller that moves back and forth under the silo's opening and around which the belt winds as the roller moves toward the said other side of the silo's opening.

Further it is known from the German Auslegenschrift No. 1943940 that a flat-bottomed silo may be emptied of bulk material that is still in the silo by tilting the bottom toward the outlet opening to empty the silo of the material that is still there.

The object of the present invention is to now provide an apparatus for closing, so as to be opened, the freight or storage tank for bulk material so that the greater the weight applied to the closing device the more securely it closes and further, so that the weight of the tank's contents is used to open the closing device.

A further object of the invention is to provide a closing device for freight or storage tank that upon opening breaks up the contents of the tank so that it starts moving more easily. It is also the purpose of the invention to achieve a closing device for freight or storage tank that upon opening tilts the bottom of the tank toward the outlet opening so that all of the material in the tank flows toward the outlet opening as a result of gravity.

SUMMARY OF THE INVENTION

Thus in accordance with the invention an apparatus is provided for openably closing a freight or storage tank for bulk material in which the roller's or roller system's actuating means comprise means that are fitted on the tank's frame and guide the roller or roller system between two extreme positions by way of a top dead center and operating means for forcing the roller or roller system over the top dead center.

Thus with the aid of the invention a closing device for a freight and storage tank is provided that is partially self-closing and partially self-opening. When the roller or roller system has passed the top dead center, it immediately becomes self-closing or self-opening depending upon onto which side of the top dead center it has fallen. When the tank is opened, the roller or roller system must be raised slightly as it is removed from in front of the opening. This creates a breaking-up effect in the tank's contents which aids in unloading the material from the tank. When the roller or roller system has passed the top dead center, the weight of the unloading material forces the roller or roller system to open still further, and the closing device has thus become self-opening. After the tank is emptied and the roller or roller system is moved toward the closed position, it becomes in the same manner self-closing after it has passed the top dead center. Both the weight of the roller or roller system and the weight of the material being feed into the tank force the roller or roller system into its closed position and the more securely closed the greater the weight applied to the roller or roller system.

DESCRIPTION OF THE PREFERRED EMBODIMENTS

Figure 1:
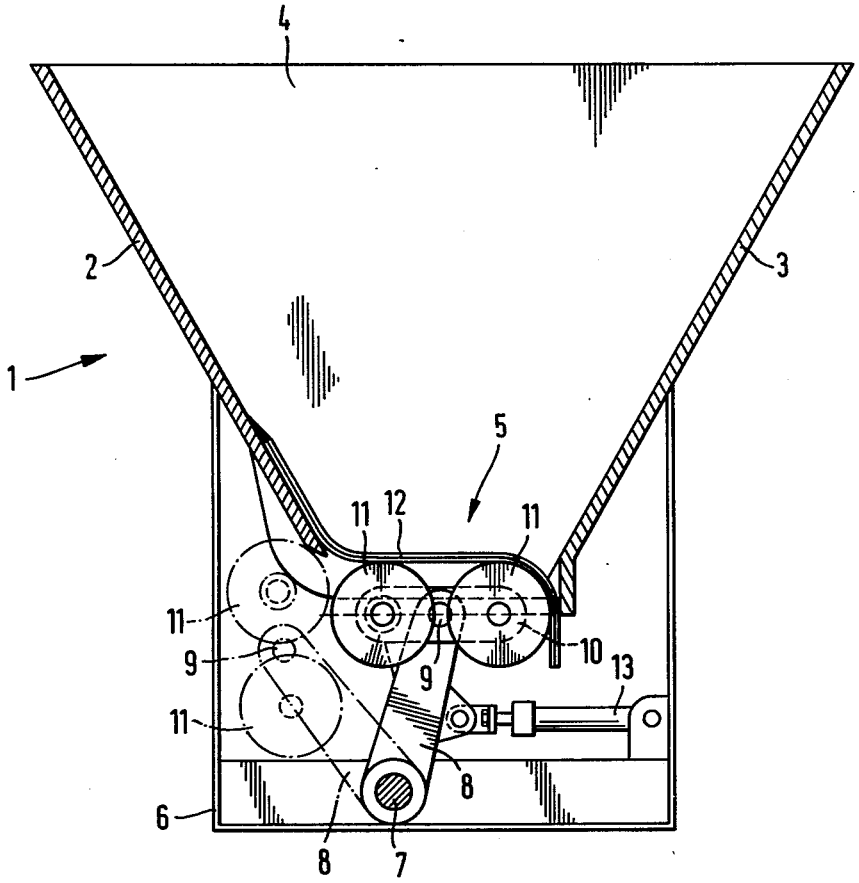
FIG. 1 is a cross-sectional vertical view of a silo equipped with a closing device in accordance with the invention, FIGS. 2 and 3 similarly illustrate cross-sectional vertical views of an alternative realization equipped with an auxiliary device that changes the shape of the silo's bottom.

In FIG. 1 the storage tank in general is designated by the number 1. On the bottom of the storage tank 1 there is an outlet opening 5 toward which the side walls 2 and 3 and the end walls 4 are inclined. The storage tank 1 is also supported by the frame construction 6, onto which the openable closing device in accordance with the invention is fitted, below the opening 5.

The outlet opening 5 is a long, narrow opening which covers the whole length of the storage tank 1. The openable closing device in accordance with the invention comprises arms 8 that are fastened with bearings to the tank's 1 frame construction 6, around the tank's 1 longitudinal axle 7 at a longitudinal distance away from each other, the upper part of the arms 8 being similarly fastened with bearings around the tank's 1 longitudinal axle 9 at the center of the support arm 10 which has two rotating rollers 11, one fitted at each end of the support arm 10 and which cover the whole length of the opening 5. The roller system formed by the rollers 11 carries a belt 12 whose other end is fastened to the inner surface of one of the tank's 1 side walls 2 and which is as wide as the opening 5 and at least long enough so that when the roller system is in the extreme position that closes the opening 5, the belt reaches over the rollers 11 and is between the other roller 11 and the side wall 3. The position of the rollers 11 when they are in the open position is schematically drawn with dashed lines.

Further a hydraulic cylinder 13 is placed between the arm 8 and the tank's 1 frame construction 6, with which the rollers' 11 arm 8 may be turned around the articulated axle 7.

The lower articulated axle 7 is between the extreme positions of the upper articulated axle 9, whereat the roller system formed by the rollers 11 moves with the aid of the hydraulic cylinder 13 from one extreme position to another by way of the top dead center. The term "top dead center" with reference to FIG. 1 refers to the position of the axle 9 in its path of movement at which the axle 9 of the roller system is exactly above the lower articulated axle 7 of the lever arm 8. Thus the rollers 11 must rise slightly when moving from the closed position to the open position illustrated by dashed lines, whereat they at the same time break up the bulk material in the tank 1, which assists in starting this material moving as it is attempting to flow out of the opening 5. Furthermore the weight of the material in the tank 1 is suited to help open the closing device after the arm's 8 upper articulated axle 9 has passed its top dead center.

After the tank is emptied the roller system formed by the rollers 11 is pulled back with the aid of the hydraulic cylinder 13, at which time the roller system formed by the rollers 11 turns to the closed position illustrated in FIG. 1. When filling the tank 1 the weight of the bulk material presses the roller 11 that is against the tank's 1 side wall 3 more firmly against the lower edge of the side wall 3 the greater the weight of the tank's 1 contents. The belt 12 prevents particles from flowing in between the rollers 11 and the tank's 1 side walls 2 and 3.

In the apparatus illustrated in FIG. 1 the closing device closes more securely the greater the weight of the tank's 1 contents. When the roller system formed by the rollers 11 has passed its top dead center with the aid of the hydraulic cylinder 13, the weight of the rollers 11 and the force that the tank's 1 contents apply to them assist in opening the closing device to the position illustrated by dashed lines in FIG. 1.

Figure 2:
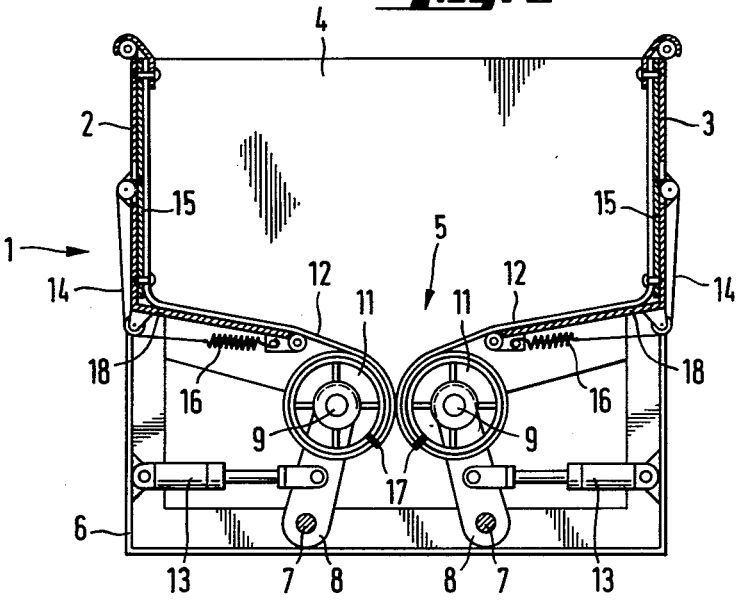
Figure 3:
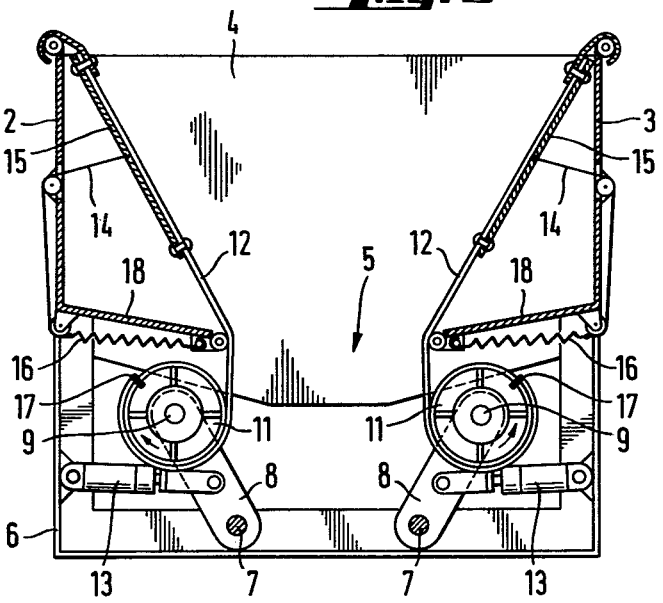

In the embodiment illustrated in FIGS. 2 and 3 the storage tank 1 is equipped with a bottom 18 that is slightly inclined toward the central outlet opening 5. The outlet opening 5 is fixed so as to close with two separate rollers 13 which are fitted on both sides of the tank's 1 central longitudinal vertical plane and which are both fastened with bearings onto the tank's 1 longitudinal axle 9 that is at the upper ends of their arms 8, whereas the arms' 8 lower ends are fastened with bearings to the tank's 1 frame construction 6 so as to turn around the same tank's 1 longitudinal, articulated axle 7. The articulated axles 7 are slightly further away from the tank's 1 central longitudinal vertical plane than the axles 9 when the rollers 13 are against each other in the position closing the opening 5. The turning movement of the arms 8 is achieved with a hydraulic cylinder 13 that is fitted between each arm 8 and the frame construction 6. Alternatively if only one cylinder is used, it is then fitted between the arms 8.

One end of a flexible belt 12 is fastened to the circumference of each roller 11 at point 17. The flexible belts 12, as well as the rollers 11, are as wide as the outlet opening 5 is long and the other ends of the belts 12 are fastened to the upper edges of the corresponding side walls 2 and 3. Furthermore a plate 15 is fastened to the lower surface of each belt 12, the plate being essentially as high as the side walls 2 and 3 and fitted against the inner surface of the side wall 2, and correspondingly 3, when the tank 1 is full, so that it is in between the side wall 2, and correspondingly 3, and the belt 12. The rollers 11 are run by motors and are fixed so as to rotate in opposite directions when in their open position so that the lower part of each belt 12 is wound around its roller 11, at which time the belts 12 tighten and rise off of the tank's 1 side walls 2 and 3 and off of the bottom 18 so that the inner surface of the tank 1 becomes inclined toward the outlet opening 5. At this time the plates 15 rise off of the side walls 2 and 3 along with the belts 12.

To return the belts 12 to their unwound position in which they are against the tank's 1 side walls 2 and 3 as well as against the bottom 18 when the rollers 11 turn with the arms 8 to in front of the outlet opening 5, the tank 1 is equipped with tightening elements which consist of a spring 16 that is fastened to the under side of the tank's 1 bottom 18 as well as a wire 14 that is fitted between the spring 16 and the plate 15 that is fastened to the belt 12, the upper end of the wire 14 being fastened to the plate 15 and the lower end to the spring 16 and the wire being fixed so as to go from the spring 16 along the outer surface of the tank 1 through a hole in the side wall 2, and correspondingly 3, to the plate 15 that is fastened to the belt 12.

As seen more specifically in FIG. 3 the spring 16 tightens when the belt 12 along with the plate 15 that is fastened to it rise off of the tank's 1 side wall 22, and correspondingly 3, as a result of the turning and rotating movement of the roller 11. As the roller 11 rotates in the opposite direction and turns to the closed position illustrated in FIG. 2, the spring 16 pulls back, with the aid of the wire 14, the plate 15 and thus also the belt 12 that is fastened to it to the position in which they rest against the tank's 1 side wall 2, and correspondingly 3, as well as against the bottom 18.

The cylinders 13 are not necessary if the spring 16 is strong enough to be able to alone pull the belt 12 back against the tank's 1 side wall 2, and correspondingly 3, and against the bottom 18 as well as at the same time to turn and to wind the roller 11 into the closed position illustrated in FIG. 2. At the same time, however, the electric motor that is fitted in the roller 11 must be strong enough to be able to alone rotate the roller 11 so as to wind the belt 12 around the roller 11 in such a manner that the rollers 11 and belts 12 move into the open position illustrated in FIG. 3.

The rollers 11 squeeze more firmly against each other the greater the load applied to them. After the rollers 11 have turned from their closed position illustrated in FIG. 2 past the top dead center that is perpendicularly above the articulated axle 7, the material flowing out of the tank 1 attempts to open the rollers 11 further so that they move into the position illustrated in FIG. 3. The rollers 11 may at the same time rotate in opposite directions so as to wind the belts 12 around the rollers 11 or alternatively the winding may be done after the rollers 11 have turned into the position illustrated in FIG. 3.

After the tank 1 is emptied the arms 8 along with their rollers 11 are turned to the front of the opening 5 with the aid of the cylinders 13 and at the same time the electric motors that are in the rollers 11 are disconnected so that the rollers 11 are able to rotate freely in opposite directions, at which time the belt 12 along with its plate 15 withdraws with the aid of the spring 16 and the wire 14 to the position illustrated in FIG. 2.

Figure 4:
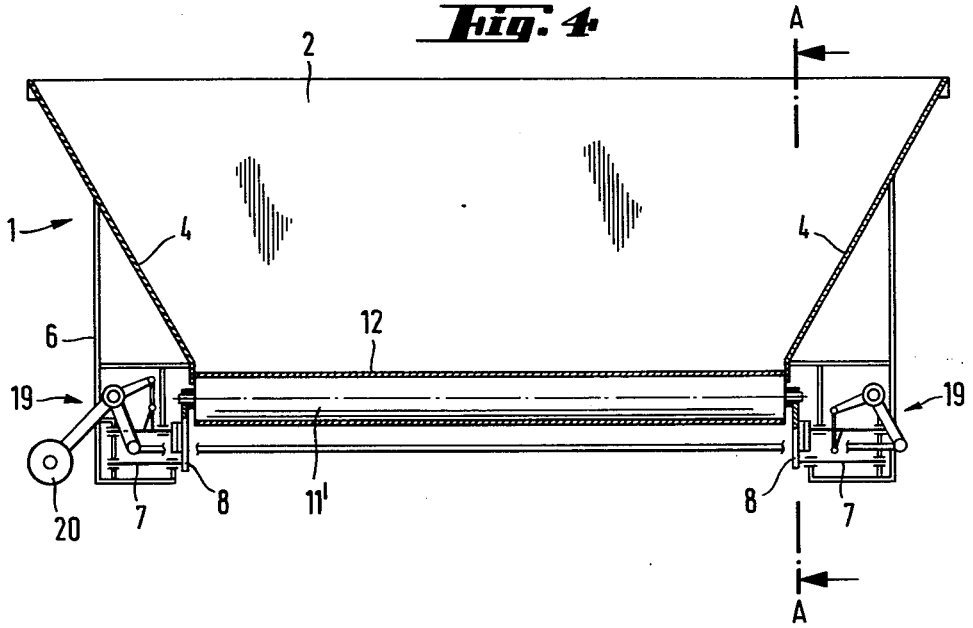
FIG. 4 illustrates a longitudinal profile of a freight tank equipped with an openable closing device in accordance with the invention.
Figure 5:
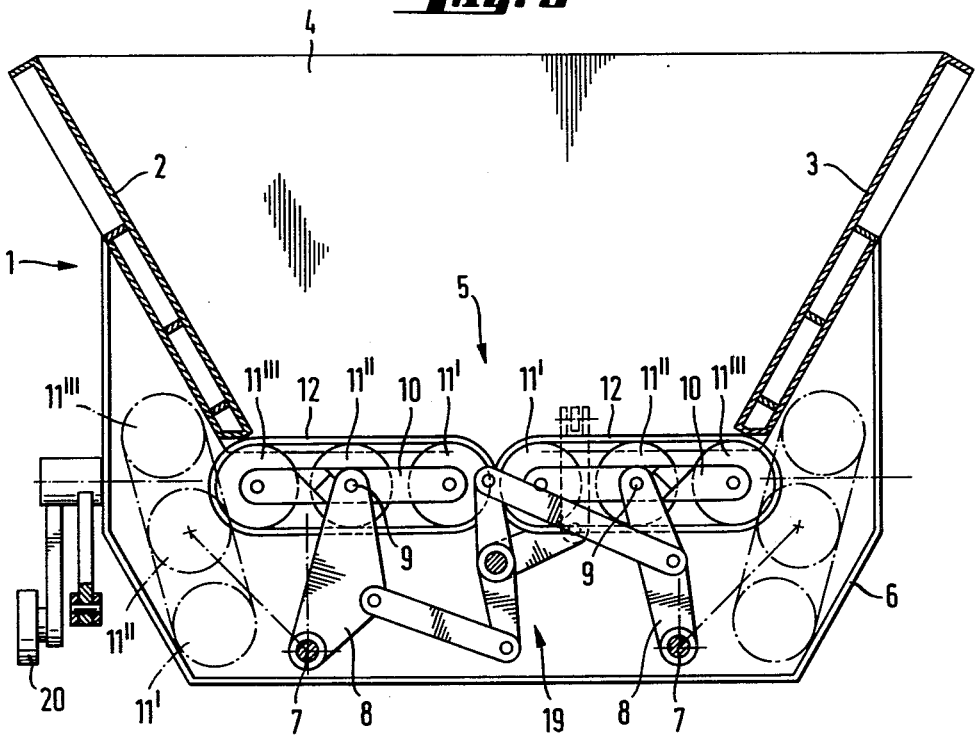
FIG. 5 is a profile of the cut along line A—A in FIG. 4.

The freight tank 1 which is illustrated in FIGS. 4 and 5 and which is advantageously placed on the railway-car's chassis (not shown in the figure) has a long and quite wide outlet opening 5 that is bordered by the lower edges of the tank's 1 inclined side walls 2 and 3 and of the end walls 4. The outlet opening 5 when opened can be closed with two roller systems that are fitted onto the tank's 1 frame 6 so as to turn in opposite directions. The roller systems are illustrated in FIG. 5 in the closed position while the open position is illustrated schematically with dashed lines.

Both roller systems consist of three rollers 11', 11'', and 11''' that are crosswise on the tank 1, one behind another and essentially cover the whole length of the opening 5. These rollers are fastened at both ends with bearings to common support arms 10 which are fastened with bearings at their center to the upper end of the lever arm 8 so as to turn around the longitudinal axle 9. The lower ends of the lever arms 8 are analogously fastened with bearings to the tank's 1 frame 6 similarly so as to turn around the longitudinal axle 7. At this point when the roller systems are against each other in the position illustrated in FIG. 5, the lower articulated axle 7 is slightly further away from the tank's 1 central longitudinal vertical plane than the upper articulated axle 9. The lever arms 8 are connected to each other with the aid of a lever system 19 that is connected so as to be operated by the manual lever 20 that is on one side of the tank's 1 frame 6 and whose movement is transferred to the lever arms 8 through the lever system 19 and moves the roller systems from the closed position illustrated in FIG. 5 to the open position illustrated in the same figure by dashed lines, and back again. The more detailed description of the lever system is not considered necessary because the manner in which the turning movement of the manual lever 20 is transferred to the lever arms 8 so that they move in opposite directions is evident to experts in this field.

An endless belt 12 is fitted around the rollers 11', 11'', and 11''' of both roller systems. In the position illustrated in FIG. 5 the weight of the material in the tank 1 presses the front rollers 11' of the roller systems with a greater force against each other the heavier the load in the tank 1. At this point the belts 12 that are between the front rollers 11' are squeezed slightly together thus sealing the split between the rollers 11' effeciently.

In the same manner the weight of the material in the tank 1 attempts to turn the roller systems around the upper articulated axle 9 in such a manner that the last roller 11''' attempts to rise, at which time the flexible belt 12 is pressed between the last roller 11''' and the lower edge of the tank's 1 side wall, 2 and correspondingly 3, forming a firm seal between the roller 11''' and the lower edge of the side wall 2, and correspondingly 3.

Upon approaching an unloading station the freight tank's 1 manual lever 20 is fixed so as to colide with an immovable catch near the unloading station, the surface of the catch being advantageously inclined so that the manual lever 20 is turned upward, at which time its movement is transferred to the lever arms 8 through the lever system 19 so that the lever arms 8 move the roller systems away from each other. As the roller systems move away from each other, the belts 12 perform as roller belts which aid in the opening of the closing device, because no friction is formed between the tank's 1 contents and the upper surfaces of the belts 12 when the rollers 11', 11'', and 11''' are able to rotate freely on the support arms 10. After the upper articulated axle 9 has passed the top dead center at which point it is perpendicularly above the lower articulated axle 7, the weight of the material flowing out of the tank 1 assists in opening the roller systems into the position illustrated in FIG. 5 with dashed lines. After the tank 1 is emptied and it has moved forward, the manual lever 20 colides with another catch that turns it downward, at which time the manual lever's 20 movement is once again transferred to the lever arms 8 through the lever system 19 so that the lever arms 8 are turned back into the closed position illustrated in FIG. 5. Thus the emptying of the freight tank 1 may be done as the tank 1 is moving, for example along the rails.

The freight tank illustrated in FIGS. 4 and 5 is especially suitable for the transporting of coal, peat, and chips, and other such loose goods by railway from one place to another.

Figure 6:
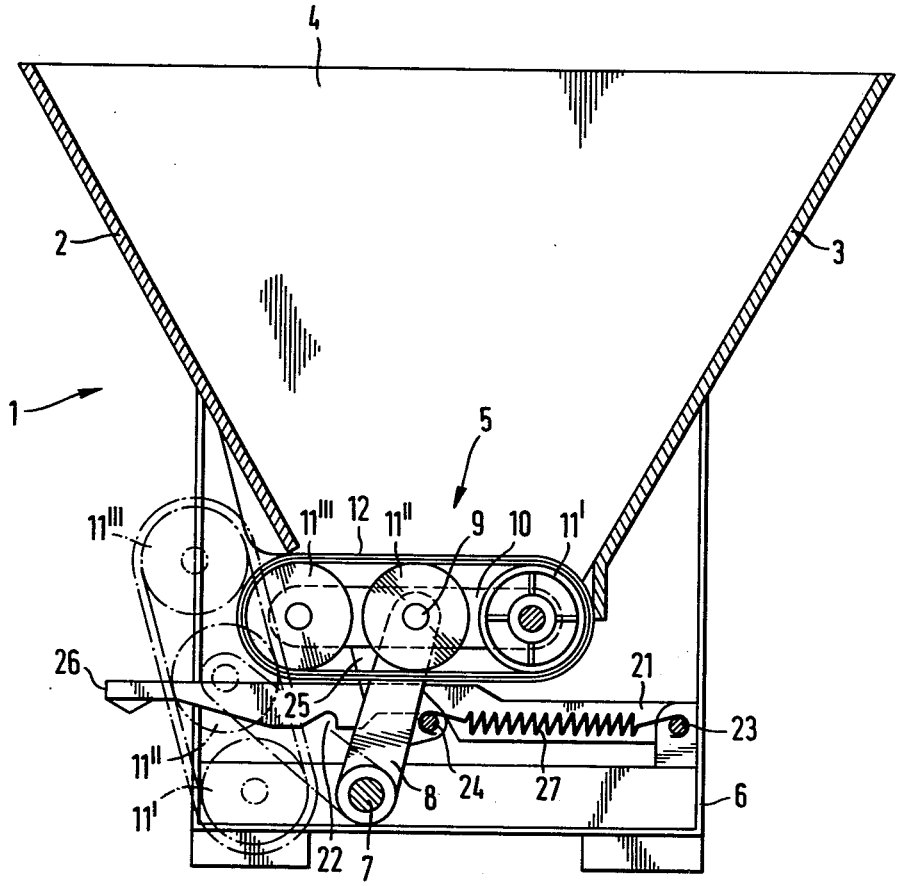
FIG. 6 is a cross-sectional vertical view of a storage tank equipped with a realization proposed in the invention.

FIG. 6 illustrates an extensively automated but yet simple realization of an openable closing device in accordance with the invention. In this realization the outlet opening 5 that is bordered by the lower edges of the tank's 1 side walls 2 and 3 as well as by the lower edge of the end walls 4 is closed, so as to be opened, with one and only one roller system which consists of three rollers 11', 11'', and 11''' which are placed crosswise under the opening 5 one behind another and which are essentially as long as the opening 5. Both ends of the rollers 11', 11'', and 11''' are fastened with bearings onto two support arms 10 so that the rollers 11', 11'', and 11''' rotate, and the support arms 10 are in turn fastened with bearings, so as to turn, at their center onto the upper end of the lever arms 8, around the tank's 1 longitudinal axle 9, whereas the lower ends of the lever arms 8 are similarly fastened with bearings, so as to turn, to the tank's 1 frame 6 with the aid of the tank's 1 longitudinal articulated axle 7. When the roller system is in the closed position illustrated in FIG. 6, the upper articulated axle 9 is on the tank's 1 central longitudinal vertical plane, whereas the lower articulated axle 7 is a smaller distance away from this vertical plane, so that the roller system when moving with the lever arm 8 must move from the closed position illustrated in FIG. 6 by way of the top dead center to the open position illustrated in FIG. 6 with dashed lines.

In this embodiment the first roller 11' of the roller system is run by a motor and moves the roller system into the open position illustrated by dashed lines in FIG. 6, when the front roller 11' is rotated with the aid of its motor. After the roller system has passed its top dead center, the weight of the material flowing out of the tank 1 assists in moving the roller system into the open position illustrated by dashed lines in FIG. 6.

A lever bar 21 is also fitted onto the tank's 1 frame 6. One end of the lever bar 21 is fastened with bearings, so as to turn, to the tank's 1 frame 6 with the aid of its longitudinal axle 23 and near the middle of the lever bar 21 there is a downward open slot 22 that is fitted so as to catch the tap 24, that is near the middle of the lever arm 8 and protrudes in the tank's 1 longituduinal direction, when the roller system opens and the lever's 8 tap 24 slides along the lower edge of the lever bar 21 toward its other end. The lever arm's 8 tap 24 and the lever bar's 21 slot 22 prevent the roller system from turning back to the closed position after the motor that is fitted in the front cylinder 11' and that turns the endless belt 12 has stopped running and the spring 27 that is fitted between the lever arm's 8 tap 24 and the lever bar's 21 articulated closed position illustrated in FIG. 6. The tightened spring 27 may be released and the roller system allowed to return to the closed position by lifting the free end 26 of the lever bar 21 so that the lever arm's 8 tap 24 is released from the lever bar's 21 slot 22.

If necessary the spring 27 may be equipped with a hydraulic absorber. So as to prevent the roller system from turning around the upper articulated axle 9 in the wrong direction when the motor in the front roller 11' is started, a catch 25 is fitted on the lever arm 8 onto which the lower edge of the rollers' support arm 10 that is between rollers 11'' and 11''' rests when the roller system is in the closed position illustrated in FIG. 6.

What is claimed is:

1. An apparatus for closing, so as to be opened, a tank for bulk material, the tank having at least one long emptying opening on the bottom, one or two flexible belts that are essentially as long as the opening and are fastened at one end to the tank, roller means that is under the belt and of approximately the same length and that supports the belt in the closed position and can be removed from the closed position, and means for moving the roller means across the opening between two extreme positions, said means for moving the roller means comprising guiding means fitted onto the tank's frame to guide the roller means between the said two extreme positions, in a convex arcuate path providing the roller means with a top dead center, by way of the top said dead center and operating means for forcing the roller means over the said top dead center.

2. The apparatus of claim 1 in which the guiding means for the guiding means comprise two lever arms that are fitted at the opening's longitudinal distance apart from each other and whose upper ends are attached with bearings to the roller means and whose lower ends are attached with bearings to the tank's frame at such a point to pivot around an axis in the longitudinal direction of the opening so that the roller means top dead center is between the said two extreme positions.

3. The apparatus of claim 1 in which a flexible belt is fitted on the inside of the tank which belt is long enough so that when one end thereof is attached to the upper edge of the tank's side wall and the other end to the roller means, the weight of the bulk material urges the belt against the tank's side wall and against the bottom when the tank is closed, the roller means further comprising means for rotating that roller means onto which the other end of the belt is attached so that the flexible belt is wound around said last-mentioned roller means in such a way that the belt tightens and forms a sliding surface in the tank that is inclined toward the opening and furthermore the tank comprises returning means that is fastened onto the belt and that strains as the other end of the belt is wound around the last-mentioned roller means and that retracts the belt against the tank's side wall and bottom after the bank has been emptied.

4. The apparatus of claim 1 in which the roller means' operating means comprises at least one drive cylinder between the tank's frame and the roller means or its guiding means.

5. The apparatus of claim 1 in which the roller means comprises at least two support arms that are at the opening's longitudinal distance apart from each other and that are articulated to the guiding means so as to pivot around an axis longitudinal with the opening, the roller means being mounted with bearings onto the support arms in such a way that the roller means that is trailing in the closing direction is pushed around the support arms' articulated points upward against the opening's edge as a result by the weight of the tank's bulk material preventing the roller means from turning away from the opening, the attachment of the roller means to the support arms being such that at the same time it allows the roller means to freely turn away from the opening pivoting around the support arms' articulated points after the roller means has returned from over its top dead center.

6. The apparatus of claim 1 in which the flexible belt is long enough to be pressed firmly between the roller means and the opening's edge or another roller means when the first-mentioned roller means is in the extreme position closing the opening.

7. An apparatus for closing, so as to be opened, a tank for bulk material, the bottom of the tank having at least one long emptying opening, the apparatus comprising one or two roller means that are under the opening and movably fitted onto the tank's frame and being of approximately the same length as the opening, the roller means having an endless belt that essentially covers the whole width of the opening and that is fitted over the roller means, means fitted onto the tank's frame to guide the roller means across the opening between two extreme positions, in a convex arcuate path providing the roller means with a top dead center, by way of said top dead center, and operating means to force the roller means to move over the top dead center.

8. The apparatus of claim 7 adapted to be used in freight tanks in which the or roller means' operating means comprise power transmission means that are connected to the guiding means and attached with bearings to the freight tank's frame and adapted to operate the guiding means that transfer the roller means over the top dead center, upon receiving an impulse from outside of the freight tank.

9. The apparatus of claim 7 in which the the roller means' operating means comprise a power source that is connected to run at least one roller means so as to move the upper part of the endless belt that is fitted around the roller means in the opposite direction from the roller means' opening direction and aids in removing the roller means or it removes the roller means from the opening.

10. The apparatus of claim 9 in which the roller means' operating means further comprises a returning means adapted to strain as the roller means is opened by the power source and by the weight of the bulk material so that the returning means retracts the roller means to its closing position and locking means to lock the roller means into the open position.

* * * * *

UNITED STATES PATENT AND TRADEMARK OFFICE

CERTIFICATE OF CORRECTION

PATENT NO. : 4,460,110

DATED : Jul. 17, 1984

INVENTOR(S) : Pertti J. Helander

It is certified that error appears in the above-identified patent and that said Letters Patent are hereby corrected as shown below:

On the title page;

(73) Change the assignee's name to: Esko Poltto Oy

Claim 2, col. 7, line 50: delete "guiding" and substitute --roller--.

Claim 8, col. 8, line 47: delete "or".

Claim 9, col. 8, line 54: delete "the" (third occurrence).

Signed and Sealed this

Ninth Day of July 1985

[SEAL]

*Attest:*

DONALD J. QUIGG

*Attesting Officer* *Acting Commissioner of Patents and Trademarks*